US005888274A

United States Patent [19]

Frederick

[11] Patent Number: 5,888,274

[45] Date of Patent: Mar. 30, 1999

[54] TRIBOELECTRIC PROPERTY MODIFICATION AND SELECTION OF FABRICS FOR FILTRATION APPLICATIONS

[75] Inventor: Edward R. Frederick, 294 Sunset Rd., Pittsburgh, Pa. 15237

[73] Assignee: Edward R. Frederick, Pittsburgh, Pa.

[21] Appl. No.: 920,230

[22] Filed: Jul. 23, 1992

[51] Int. Cl.[6] ..... B03C 3/30

[52] U.S. Cl. ..... 95/59; 8/115.6; 8/444; 8/547; 8/549; 55/524; 55/528; 55/DIG. 5; 96/17; 96/69

[58] Field of Search ..... 55/2, 6, 103, 524, 55/527, 528, DIG. 5, DIG. 39; 8/444, 547, 549, 115.6; 95/63, 69, 70, 59; 96/17, 55, 57, 69

[56] References Cited

U.S. PATENT DOCUMENTS

| | | | |
|---|---|---|---|
| 3,307,332 | 3/1967 | Grace et al. | 55/103 |
| 3,574,790 | 4/1971 | Young et al. | 55/DIG. 39 |
| 3,802,837 | 4/1974 | Bohnert et al. | 8/547 |
| 3,933,423 | 1/1976 | Looney | 8/444 X |
| 3,933,664 | 1/1976 | Nagashima et al. | 8/444 X |
| 3,986,530 | 10/1976 | Maekawa | 55/103 X |
| 4,229,187 | 10/1980 | Stockford et al. | 55/103 X |
| 4,494,956 | 1/1985 | Schafer et al. | 8/444 X |

OTHER PUBLICATIONS

Hawley, G.G., *The Condensed Chemical Dictionary,* 8th Edition, Reinhold Publishing Co., 1971, pp. 427–482, 782, 784, 785.

"An Overview of Current Fabric Filtration Technology", E.R. Frederick, Jul. 31, 1984.

"Collection of Electrically Charged Particles in Filters,", Journal of the Air Pollution Control Association, vol. 26, No. 1, Jan. 1976.

"Fibers, Electrostatics, and Filtration", Control Technology News, Apr. 1980, E.R. Frederick.

"Routine Prescription of Fabric Filter Media with Optimal Performance Properties, Triboelectrically (Not Artificially): Fact or Fiction?", Edward R. Frederick, Fluid/Particle Separation Journal, vol. 5, No. 1, Mar. 1992.

Electrostatic Effects In Fabric Filtration, vol. II, E.P.A., Jul. 1978.

"Some Effects of Electrostatic Charges in Fabric Filtration", E.R. Frederick, Journal of Air Pollution Control,Dec. 1974.

"The AFC Static Generator and Evaluator", E.R. Frederick, American Dyestuff Reporter, Jun. 15, 1968.

"Electrostatic Effects in Fabric Filtration", Frederick, CMU, Jul. 1978.

"How Dust Filter Selection Depends on Electrostatics", E.R. Frederick, Chemical Engineering, Jun. 26, 1961.

*Primary Examiner*—Richard L. Chiesa

[57] ABSTRACT

A method is provided for specifying and altering the electrical properties of fibers and fabrics. This allows the prescription of filter media prepared from these constituents for consistently optimum or near optimum performance in the collection of particulate matter. The method may include the steps of determining the triboelectric properties of fabrics having other desirable filter media characteristics, modifying the triboelectric properties of these fabrics as needed to preferentially selected properties and utilizing, selectively, modified fabrics as the filter medium for optimally attracting gas entrained electrically charged particles to the surface of the filter. The modification of the triboelectric properties may be realized chemically or by dyeing the fibers and fabric. The selected fabric has triboelectric characteristics that provide maximum attraction for the dust to be filtered so that when possible, as is most common, agglomeration of the particles on the surface of the filter is promoted, and the density of the particulate on the surface of the filter is increased. Additionally, determination and modification techniques are proposed for fabrics utilized as filter media and the blending of the included fibers, filaments or yarns of selected fibers so modified. These are then combined into a medium for use in filtering particulate matter having particles of various electric charges.

32 Claims, No Drawings

TRIBOELECTRIC PROPERTY MODIFICATION AND SELECTION OF FABRICS FOR FILTRATION APPLICATIONS

BACKGROUND OF THE INVENTION

1. Field of the Invention

This invention relates to the modification and manipulation of the triboelectric properties of filter material to provide fabrics having predictable triboelectric properties for use as filter media. More particularly, the invention relates to the modification or adjustment of filter fabric media according to predictably calibrated triboelectric properties for use in dust collection operations so as to optimize the performance of the filters in relation to the particulate matter to be filtered.

2. Description of the Prior Art

The U.S. Environmental Protection Agency (EPA), in 1970, originally set forth a National Ambient Quality standard for particulate matter. Since that time, U.S. industry has commenced practices which reduced the mass of particulates on an average by 20% by the early 1980's, despite increased industrial developments. In view of further industrial expansion and especially in view of the projected greater use of coal to generate electrical power, particulate pollutants will have a tendency to increase unless appropriate control measures are taken. As regulations became more stringent, especially in regard to particle size, control devices for removing particulate matter became more restricted. The most common methods in increasing order of apparent potential acceptability based on performance are: mechanical collectors, particulate wet scrubbers, electrostatic precipitators, and fabric filters. Fabric filtration is a process not greatly different in principle of operation from that of the common home vacuum cleaner. Particulate matter is removed from a dirty air (gas) stream by virtue of separation processes that occur at or near the fabric surface. Five such mechanisms are identified in the separation process: inertial deposition, brownian movement, direct interception, gravitational sedimentation and electrostatics. Except for the electrostatic involvement feature, each of these has been well described in the prior art. Because filtration is among the most reliable, efficient and economical methods for removing particulate matter from gases, baghouses are being applied more universally for controlling emissions. As an example, baghouses may be applied to coal-fired utility boilers, and are one of the few air pollution control techniques easily capable of meeting the more stringent anticipated emission standards.

Although fabric filters are well known as being capable of collecting very small particulates, a high level of removal from industrial process gases is not routinely achieved. One reason for this is that not all fibers used in constructing the filter perform in the same manner, even where the chemical composition of the fibers is presumably identical in a favorably constructed fabric. Additionally, it appears that natural electrical forces clearly influence the filtration process. In fact, it appears that substantially all industrial processes produce particulate matter with charges, positive and negative. Although considerable information on the mechanics of the filtration process for uncharged particles is available, very little has been provided with regard to natural electrical effects in fabric filtration. This is despite the fact that particulate matter reaching the fabric filter is rarely uncharged and the medium itself is rarely devoid of an electric field. Accordingly, particles entering conventional collectors are mostly charged, sometimes far more extensively than at other times, but usually of mixed polarity. The type of generating process determines the magnitude of the charge, with grinding and other energy intensive operations producing particulate matter with extremely high levels of charge.

It is generally accepted that electrostatic attraction draws particles from the gas stream to fibers if the two are oppositely charged. Even if only one of the particles or filtering fabric is charged, a naturally induced charge will be created on the other. This results in a polarizing force that causes attraction and particle movement from the gas stream to the oppositely charged fiber. However, although as stated above, the particulate matter and/or the fabric filter may have electrostatic charges thereon, the polarity, magnitude and durability of the triboelectrically induced charge depends upon the inherent properties of the materials, including their chemical make-up and the electrical resistivity.

Electrical augmentation, the practice of electrically charging the gas-entrained particles and/or applying an electric field to the collecting medium, can provide excellent filtration features. These artificial charging conditions are, however, applicable only to non-combustible, electrically chargeable particles. Another limitation is that they require special processing and collection facilities, electrodes, electrical circuits, and the like. The most commonly proposed electrical augmentation techniques utilize a corona discharge to impress a charge on the particulate matter and/or a high D.C. voltage on wire electrodes appropriately located on or near the surface of the collecting fabric. One of the more serious limitations of electrode systems proposed for such augmentation is the short life of the circuitry.

A very significant portion of the improved filtration performance gained by electrical augmentation or artificial charging may be achievable simply by balancing the natural charging properties of the fabric with those provided by the particulate matter. By utilizing natural charges, that is by using a fabric filter medium of appropriate inherent triboelectric properties relative to those of the particulate matter being collected, it is possible to deposit a low air-flow resistant cake without electrical augmentation. By suitably balancing the natural triboelectric properties of the medium in relation to those of the particles being collected, conditions are realized for approaching the ultimate level of filtration performance now attained only by electrical augmentation.

Practically all of the commercial fibers used for filtration fabrics respond to contact electrification and because of molecular variations, gain or lose electrons differently. Different fibers, therefore, become charged at different polarities. When listed in a downward order from electropositive to electronegative, a series may be developed, referred to as the triboelectric series (TE), and any material fabric or dust, may be included according to its electrostatic polarity relative to others in the list. Triboelectrification is the frictional process by which substances such as fabrics, particles, and the like, when abraded or rubbed by other substances and separated, develop electrostatic charges. Polarity of the acquired charge on the rubbed material to that on the rubbing substance depends upon the inherent character of the rubbed substance. The magnitude of the acquired charge depends upon various qualities of both the rubbed and the rubbing materials including the differences in their spacing in the triboelectric series, the roughness of their surfaces, the environment to which they are exposed and other parameters. Natural charging refers to the charging process that occurs naturally in the course of handling materials of all types. Particulate matter acquires electrostatic charges by contact with or rubbing against other substances such as the walls of ducting or during formation/production as generated at high temperatures, grinding, and the like. The triboelectric properties of fabrics generally are either not significant or have not been recognized to be critical or useful in their normal service applications.

In dry filtration, however, this characteristic of the medium appears to control the process and dictate its performance. An ideal balance between the electrostatic charges on the collecting filter medium provides optimal or near optimal filtration parameters in terms of pressure drop, efficiency, gas flow-through, fabric cleanability and other dependent variables. Although non-electrically augmented filtration operations presently are anticipated to be the most common collection methods, controlling the filter operation by balancing the electrostatic properties of the particles and of the filter medium has received little or no consideration.

The opportunity to utilize natural electrostatic effects fully has been restricted to some extent by non-availability of appropriate media and most seriously by the triboelectric limitations of commercially available fabrics. The most serious problems have included triboelectric non-uniformity among even supposedly identical fabrics, and the limitations of the inherent triboelectric properties of an otherwise suitable fabric. The fabrics marketed for filter media use presently do not always permit the choice of the desired triboelectric properties, neither are the fabrics constructed from blends of fibers having a selectable preferred balance of electropositive and electronegative fibers for filtering gas entrained particles of both charges, to optimize the process.

SUMMARY OF THE INVENTION

The present techniques overcome the triboelectric limitations imposed on commercially available fabrics by preferentially and specifically adjusting or modifying the triboelectric properties of fabric filter media in order to realize optimal or near optimal filtration performance in the collection of precharged particulate matter. The selection of the preferred filter fabric may then be made on the basis of electrical properties as well as upon the need to meet the temperature, chemical, economic and other requirements.

A simple modification process to provide consistent, desirable triboelectric properties is described. The process modifies useful fabrics such that they may be consistently and accurately categorized and assigned to a specific position in the triboelectric series. This position then corresponds to one which is most optimal for a particulate being filtered. Additionally, fibers may be modified triboelectrically and a fabric produced from a blend of fibers having the desirable properties for use as filter fabrics wherein the particulate being filtered has various electrical charges. For example, DACRON polyester fibers vary greatly in their triboelectric properties, and although ideal as filter medium for other reasons, may not be most favorably utilized unless appropriately modified in their electrical properties to provide consistent performance. Accordingly, the utilization of DACRON based upon its triboelectric properties is not always practical unless the fiber or the fabric made of the fiber is preferentially altered to provide the desired TE qualities.

The described alteration may be made chemically by conventional chemical means, and more preferentially by dyeing. Dyeing provides the necessary chemical changes while further providing a simple and accurate identification method for the chemically altered fabrics. In either case, the alteration must be durable in order to withstand the conditions of service. Dyes are preferentially applied since in addition to achieving the needed electrical features routinely in commercially available facilities, the presence of a colorfast specific color denoting a position in the triboelectric series has considerable appeal. With prior knowledge of the subject particulates charge features, the filter fabric required to provide optimal collection parameters can be determined easily. For example, the advantage of having a highly electropositive red fabric and a very electronegative blue fabric or, perhaps, a blend of the fibers or yarns from the two base fibers in a fabric having a purple shade, would have specifically useful features. The first two would offer the needed triboelectric properties for optimally collecting negative triboelectric, commonly known as TE(−), or positive TE, known as TE(+) particles. The fabric containing the blend mixture of fibers/yarns would serve best in collecting dust in which half of the particles were positively charged and half were negatively charged. It would be apparent that the desirable blend will be governed by the actual charge distribution of particles in the particulate matter to be filtered.

A method is disclosed, therefore, by which the TE properties of fibers in fabric filter media may be determined and changed predictably to meet requirements dictated by the TE properties of the particulate matter being collected and, thereby, to attain optimal or near optimal collection parameters.

Any alteration of a fiber's TE property must be realized by a process that makes the change relatively permanent. Since charges are generated and carried on the surface of the fibers, an unbonded surface coating is useless for charge modification. But two fundamentally different types of treatment have been shown to be effective. One of these is by coordinate bonding through chemical addition or substitution with the substrate fiber to form a new, different and chemically bonded finish with suitable ionic qualities to influence the TE as desired. There are several processes of this type, two of which have been used and described below with the TE results indicated in Table 2 and another which is mentioned.

Disperse dyes are prime examples of those agents that modify the surface by absorption to become a new and relatively permanent part of the fiber. Other dyes that become part of a fiber's surface and provide new and different ionic features influence the TE properties of these modified fibers differently.

Chemical Reactions for TE Modification

Any reagent capable of reacting with the fiber substrate, polymeric or monomeric, and providing a characteristic ionic group, will serve to modify the TE properties of that fiber. For modifying polyester as well as other polymeric fibers with active hydrogen atoms or those with bonded water molecules, it is possible to effect modification with such reagents as the isocyanates, silanes and Grignards which become a new part of the fiber and, therefore, may alter its TE properties. Evidence is provided in NATURE, 349: 683 (1991) that water forms hydrogen bonds to the aromatic pi electrons of certain organic compounds like the polyesters and RYTON, for example. With isocyanate on RYTON:

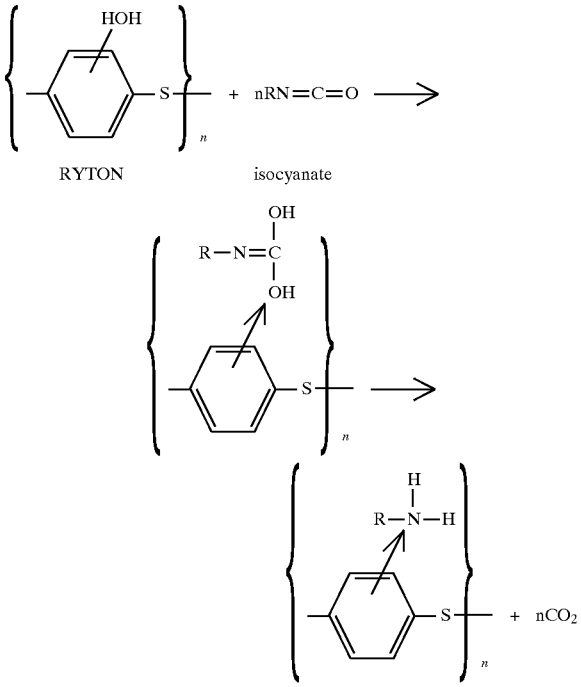

With dimethyldichlorosilane on RYTON to produce a silicone complex:

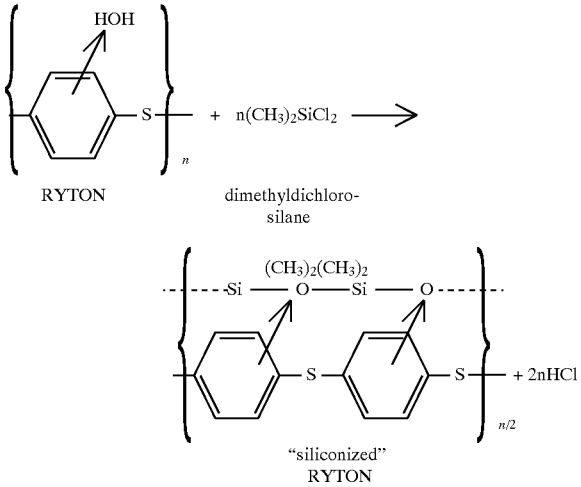

Isocyanate Reactions

The ability of isocyanates to perform in this way has been demonstrated clearly by the treatment applied by Mobay Chemical Company to samples of the CS&S, bulk knitted polyester filament yarn filter fabric. The extremely high TE (+) properties imparted by some of the treatments as identified below is verification that new surfaces with cationic features have been achieved by direct reaction with the polymeric or monomeric reagents to form a durable, abrasion resistant, reacted finish.

Isocyanate Reaction With Other Active H Atoms

Examples are given utilizing polyester, or pe.

$\{RN{=}C{=}O+R^*OH(pe)\rightarrow RONHR^*(pe)+CO_2\}$

Reference should be made to Table 2 for the relative TE positions of treated fabrics.

Mobay A-(pe)+Bayhydrol 123 (reaction with polymeric pe)

Mobay B-(pe)+Desmodur E-21 (MDI=methylenediphenyldiisocyanate) (crosslinks through active H/moisture on pe)

Mobay C-(pe)+Desmodur N-1 (HDI=hexamethylenediisocyanate) (crosslinks through active H/moisture on pe)

Mobay D-(pe)+Impranil DLN polyurethane (15%)

Mobay E-(pe)+Bayhydrol 123 (15%)

Mobay F-(pe)+Desmodur N-75 and Desmophen (670A-80) (Desmophen N-75 crosslinks with Desmophen (670A-80 on pe))

With reference to Table 2, the differences in TE contributions of those treatments which react with the polyester polymer and produce a strong cationic influence compared to those that provide a less strong cationic surface coating will be apparent from the locations of such treated CS&S knitted (pe) Dacron fabrics in the series. The more or less electropositive contributions of those reagents that become part of the fiber and provide an amine or amide (TE+) end group is apparent.

Silane Reactions

Silanes react with moisture, loosely or pi-bonded to a complex polymer, for example, HOH:

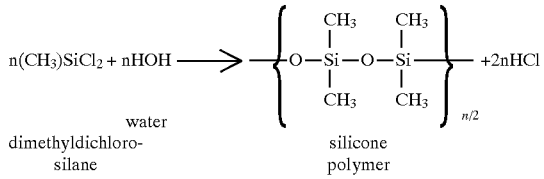

and with pi-bonded water of pe, or RYTON:

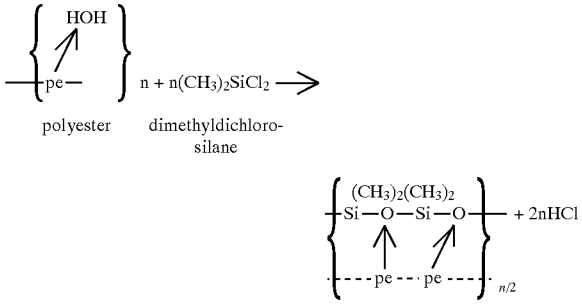

Grignard Reactions

Among other reagents capable of changing the TE properties of fibers are those of the Grignard type. These are formed from alkyl halides with metallic magnesium, usually in the presence of anhydrous ethyl ether, other higher series ethers, tertiary amines and even hydrocarbons:

$R^*MgX+(HOH,\ ROH,\ RHO,\ or\ RNH_2)\rightarrow(HOMgX,\ ROMgX,\ RHMgX,\ or\ NHMgX)+R^*H$ The reactions allow Grignard reagents to modify fibers with a variety of endgroups including active hydrogens, pi-bonded or otherwise attached water molecules, primary and secondary amines, acidic groups, alkyl halides and those containing acetylenic groups. The reactions may be considered as follows:

with an active hydrogen $RH+R'MgX\rightarrow RMgX+R'H$ with water $HOH+R'MgX\rightarrow HOMgX+R'H$ with amines $—NHH+R'MgX\rightarrow—NHMgX+R'H$ with acids —C═O—OH+R'MgX→—C═O—OMgX+R'H with halide RX+R'MgX→$RMgX_2$+RR' with acetylinic groups —C≡CH+R'MgX→—C≡CMgX+R'H

Dyeing Processes

Dyes become part of the fiber surface by absorption. Any dye, therefore, capable of penetrating and changing the fiber's TE properties by introducing a different ionic group, offers a means for predictably modifying this property for achieving optimal or near optimal filtration performance, especially for collecting the agglomerating types of particulate matter. MAXILON RED GRL-BR(HC)200 from Ciba-Geigy Corporation is an Azo dye made from an aryl quaternary amine and sodium napthyl sulfonate producing a triazide nitrogen. The dye becomes part of the polyester fiber, absorbing into the polymer's surface, dissolving therein, but not chemically bonded. The dye is fast, i.e., it resists fading by washing, and the like, and can be expected to remain an effective component of the polyester fiber/fabric used in the normal filtration environments to which it is exposed. The presence of amine and/or amide groups account for this dye's ability to confer electropositive TE qualities. The surface solution or adsorption of the dye contributes to the fastness or durability of the modification. RITE REACTIVE YELLOW B-RLN as supplied by Rite Industries Inc. is a difunctional dye of vinyl sulfone and monochlorotriazine. The presence of chlorine in this dye is believed to contribute to the TE (−) quality that it confers to the CS&S polyester. Another example is RIT ALL PURPOSE CONCENTRATED TINT AND DYE, produced by Special Products, an Affiliate of CPC International Inc. While the compositions of these dyes have not been revealed, it will be obvious from the locations of the RIT-dyed polyester fabric in Table 2, the various dyes not only provide different colors but also impart markedly different TE properties.

Firestone's Solution Dyed Polyester Fibers/Fabrics

Fabrics with yellow solution dyed polyester filament yarns in the filling and different colored solution dyed polyester filament yarns in the warp as provided by Firestone Fibers and Textiles Company, Box 450, Hopewell, Va. 23860, were evaluated triboelectrically. Not only were the positions of the six different fabrics in the TE series found to be quite different but the samples also produced substantial variations in generated voltage when rubbed by the reference material. These effects are indicated as follows:

| color | TE | Total V* |
|---|---|---|
| blue | +4.1 | 14.0 |
| green | +2.5 | 6.5 |
| orange | +0.1 | 9.4 |
| red/orange | +0.04 | 14.2 |
| yellow | +2.5 | 6.5 |
| white | +1.5 | 15.5 |
| black | +1.3 | 15.2 |

While the types of dye used on these polyester filament yarns are not identified except that they are of the solution type, it will be evident that each has a different influence on the TE properties of the same polyester fiber and, therefore, might be used to alter such features predictably.

The process thus provides a method for selecting a fabric filter by preferentially and specifically adjusting the TE properties of known fabric filter media to conform to a specific charge polarity and magnitude calibrated for the collection of known charged particulate matter.

Additionally, the process provides a grouping of filter fabrics modified through the preferential adjustment of the TE properties of available useful fabrics for selective adoption in filtering particulate matter having charged particles attracted optimally to materials only having certain TE properties.

Modification of the TE properties of known fibers to specific locations in the TE series is disclosed, such that a fabric may be constructed having a blend of fibers of various selective TE properties for use as a filter medium in filtering particulate matter having particles of various charge distribution.

A method is also provided to select a filter for a particular filtration application, the method including the steps of determining and changing the TE properties of a fabric to conform to a specific charged polarity and magnitude, constructing filters from materials calibrated to such properties, determining the charge polarity and magnitude of particulate matter to be filtered, and selecting filters calibrated to optimally attract such particles and cause aggregation of those that are subject to such transformation. Accordingly, the present invention includes the determination of the TE properties of fabrics having other desirable filter media characteristics, modifying the TE properties of these fabrics and utilizing, selectively, modified fabrics as the filter medium for optimally attracting gas entrained electrically charged particles to the surface of the filter. The invention also includes the determination and modification of the TE properties of fibers utilized in fabrics having other desirable filter media characteristics and blending yarns of selected fibers so modified into a fabric for use in filtering particulate matter comprising particles having various electrical charges, the yarn blend being such that certain of the fibers best attract others of the particles to the surface of the fabric.

These and other particular features and advantages of the present invention will become more fully understood upon reference to the presently preferred embodiments thereof and the examples set forth.

DESCRIPTION OF THE PREFERRED EMBODIMENTS

Particle separation by filter media occurs-by more than the simple process of entrapment of the individual particles, since the voids in most fabrics are usually many times greater than the size of the collected individual particles. Ordinarily, the separation process is relatively poor until a suitable layer or particulate matter is collected and forms a bridging type accumulation across the openings. Once a particulate base or cake is formed over the fabric surface, the collection efficiency increases to a value approaching 100%, depending on the medium, the particulate and processing conditions. Particulate matter that agglomerate on the collecting surface can be removed while some cake may remain. For those particulates that do not agglomerate on the collecting surface, less effective cleaning must be accepted in order to achieve high collection efficiency.

It is generally accepted that electrostatic attraction draws particles from the gas stream to fibers when the two are oppositely charged. When electrostatic forces of attraction are suitable, particle-to-particle contact and, thereby, agglomeration is enhanced. This is believed to be the primary basis for the porous type structure of the deposits collected under favorable conditions of electrostatic charging. In the process of separating gas entrained particulate matter by fabric filtration, efficiency of particle removal, the rate of gas flow through the fabric and the effectiveness of the cake removal operation are all maximized by formation of such a porous deposit of collected particulate matter. The ideal type of deposition is realized by optimizing the electrostatic balance between particles being collected and the collecting filter medium. Electrical augmentation by artificial charging can lead to ideal collection parameters, but for general use, the durability of the electrical circuitry and non-applicability to a combustible environment is a limitation of these processes. By balancing the particulate and fabric natural charges, a significant portion of improved contact is determined by the inherent properties of the fibers that make up the fabric, by the construction of the fabric, by the particulate itself, and by operating conditions. Therefore, the natural TE properties of the medium may be employed to deposit a low air flow resistant cake without electrical augmentation to approach the ultimate level of filtration performance now achieved by such augmentation. However, the opportunities to utilize natural electrostatic effects fully are limited to a large extent by the availability of appropriate media and more so by the variability of commercial fabrics. Accordingly, by predetermined modification of the TE properties of the medium, media may be selected to provide the best filtration performance for given particulates produced by a given process.

Consequently, an electrical balance is required between the filter media and the particles being collected, and it is important to realize that the strong electrical charge imbalance between the filter media and the particles contributes not only to attract the particles, but to attract these particles so effectively as to cause aggregation of those types of particulate matter that can undergo such a transformation. It is this aggregation or change in the effective particle size on the surface and not the inside the fabric structure, that is the key to the process provided by electrostatic interactions. Such interactions may be provided by the utilization of naturally generated electrostatic charges on the particles and on the collecting fabric. The advantage of increasing the particles size by agglomeration is evident on the basis of size alone, but such change also leads an increase in density for many types of particulate matter. This added feature assists in the removal of the collected cake during the cleaning phase of the filtration cycle simply by reason of the gravitational effect; moreover, the greater density contributes to a reduction in particle reentrainment, i.e. the drawing of collected particles or dust back up into the filter bag of a baghouse.

The triboelectric properties include the relative position, positive to negative, in the series, the magnitude of the charge generated and the rate of charge dissipation. The latter is significant since fabrics which discharge at low rates, although useful for agglomerating difficult-to-aggregate dust, are also more difficult to clean. The determination of the TE properties of fabrics may be accomplished by a controlled rubbing (or contact) and separation test as fully described in the American Dyestuff Reporter, Volume 57, No. 15, pages 31–33 dated Jul. 15, 1968. The method is quite simple, in that a narrow strip of test fabric is positioned in a frame and rubbed by a strip of reference fabric mounted on a rotatable insulated disk. The reference fabric is engaged with the test fabric and rotated through a fixed number of revolutions or time period. The test fabric is then contacted by a probe connected to an electric meter which measures the generated electrostatic voltage with respect to both polarity and magnitude. Using reference fabrics of known, predetermined and established polarity which preferably have the same construction, e.g., woven in the same pattern of essentially the same fiber/yarn sizes, other fabrics may then be located in a series relative to the reference materials by their charges when rubbed with these reference materials. Examples of these reference materials are NYLON, which is electropositive and a dinitrile, DARLAN, which is electronegative. As the trials are repeated by rubbing and separating different samples of fabric, each may then be located in this same TE series. Through repetition of this process with other fabrics, a TE series may be prepared by locating the various test fabrics relative to the reference fabrics. Such a series is shown in Table 1, which is similar to the table in EPA Report 600/7-78-142b. It should be noted that the 10 volt scale is strictly arbitrary, selected for ease in calculating values. 1000 or 5000 would be equally appropriate and possibly more realistic.

It is critical, in carrying out these tests, that the reference and test sample fabrics be clean since most foreign substances will confer different surface features. Subsequent to the TE position testing, a charge dissipation rate of the fabric is determined in order to determine the voltage remaining on the test samples after a fixed period of time, which is arbitrarily set at two minutes. This charge dissipation rate is measured as a percentage of the voltage derived from the tests made to determine the TE series. Thus, it gives a value which is a percentage of the charge lost in two minutes and again is considered to be arbitrary.

The scale for the values is arbitrarily established by setting values with respect to the known electropositive and electronegative reference fabrics and comparing the test fabrics therewith as more fully described in U.S. Pat. No. 3,487,396. Table 1 may thus establish TE positions of the various filter fabrics. The numbers included in brackets after the fabric name represent the relative TE discharge rate at 50% relative humidity. Most of the fabrics in Table 1 are wovens, while certain of the yarns are spun and others are continuous filament.

TABLE 1

A TRIBOELECTRIC SERIES
(Estimated Triboelectric Positions of Some Filter Fabrics)
(an arbitrary scale)

| | |
|---|---|
| | (+) very electropositive (+) |
| +8 | protein (WOOL A) [20%] |
| +7 | protein (WOOL B) [80%] |
| | polyphenylene sulfide (RYTON, st.) [20%] |
| +6 | —— polyamide (NYLON) {afc 800b- REF.} |
| | fiberglass [35%] |
| +5 | polyester (DACRON O) [50%] |
| +4 | |
| | polyester (DACRON A) [90%] |
| +3 | |
| +2 | |
| | polyester (KODEL) [20%], polyester (DACRON) [40%] |
| +1 | |
| | aramid (NOMEX) [60%] |
| 0 | |
| | acrylic {copolymer} (ORLON) [30%] |
| −1 | |
| | acrylic [homopolymer] (DRALON T) [30%] |
| −2 | |
| | polyester (DACRON B) [30%], polypropylene [50%] |
| −3 | |
| −4 | —— acrylic [dinitrile] (DARLAN) {afc 5546-REF.} |

TABLE 1-continued

| A TRIBOELECTRIC SERIES (Estimated Triboelectric Positions of Some Filter Fabrics) (an arbitrary scale) | |
|---|---|
| −5 | |
| | ptfe (TEFLON) [0%] |
| −6 | ectfe (HALAR) [20%] |
| | aramid (KEVLAR) [45%] |
| | (−) very electronegative (−) |

Note: All locations above +6 and below −4 are approximate.
[%] = apparent rate of charge dissipation.

In filtration, because the charges that are acquired by particles in normal processing should be neutralized at the fabric surface to promote aggregation, this condition is best achieved by means of the fabric which offers the greatest attraction, i.e., most widely separated from the dust in the TE series. All materials, including particulate matter, can be located in the TE series. Fibers with consistent TE properties offer features for accurate prescription in the collection of certain dusts. Consider, for example, the opportunities provided for filtration of a given dust at elevated temperatures, e.g., 400° F. For electropositive properties, fiberglass media is available to attract and agglomerate electronegative particles. Similarly, because of its electronegative properties, a TEFLON fabric offers those TE features well suited for attracting and aggregating electropositive particles. For a mixture of positive and negative particles, NOMEX may be expected to offer somewhat better conditions, or agglomerating features, than either of these other high temperature media.

It would appear evident that in the filtration of a dust in which the particles carry both electronegative and electropositive charges, the more ideal medium will be that which can attract particles of both polarity. Ideally, this fiber blended yarn would consist of a negative TE polarity fiber concentration equivalent to 100% minus the percent concentration of negatively charged particles and a positive TE polarity of a concentration of 100% minus the percent concentration of the positively charged particles, assuming all particles carry charges.

One clear indication of the variability in TE properties among polyester fabrics and how this influences the filtration process was indicated experimentally in a test comparing three polyester fabrics having substantially the same permeability, having relative TE positions of −2.5, +4.8 and +1.4. Electric furnace dust was utilized as the test material. The filter medium having the TE position of −2.5 short cycled and essentially failed after collecting a small amount of the dust; the filter medium having the TE location of +4.8 performed somewhat better but not well; and the filter fabric having the midrange TE position of +1.4 performed very well and could have been used for a substantial period of time to collect considerable dust.

Since DACRON fibers vary greatly in their TE properties, and are generally ideal as a filter medium for other reasons, they may not be used most favorably in every appropriate application without modification in electrical properties. Since inherent chemical properties determine the electrical characteristics that dictate the location of the material in the TE series, it is evident that the DACRON fiber types that appear in different positions in the TE series must possess different surface chemical features. Accordingly, the prescription of DACRON, based upon TE properties, is not always practical unless the fiber/fabric is preferentially altered, chemically, to provide the desired TE qualities. Chemical modification, whether by conventional chemical means or by dyeing, therefore, is the principle for adjusting the TE properties of the fabric (fibers) therein to meet known and preferred locations in the TE series as related to those of the collected particulate matter.

In aqueous processes involving fabrics, chemical alteration is often accomplished by anionic or cationic reagents. The anionic treatment allows either retention or causes an enhancement of the electronegative properties of the processed fabric while the cationic finishes alter or enhance electropositive features. When these ionically active agents are applied to media for filtration applications, they produce similar changes and also provide either the same TE polarity or a reversal in the polarity of the original substrate. For example, the reaction of a polyester fabric having inherent TE properties that locate it in the mid position of the series, with an anionic treatment, causes the fabric to become far more electronegative. Similarly, when the same basic fabric substrate is reacted with a cationic reagent, it becomes more electropositive in the TE series. Anionic reagents are those that in a liquid subjected to an electric potential, collect at the anode. These reagents are represented by such chemicals as those containing hydroxide, carbonate and phosphate. Cationic reagents in a liquid subjected to electric potential collect at the cathode. These agents are represented by chemical makeup of such active positive ions as the amines and amides. It is thus evident that the reaction may be a simple chemical, an active modifying or resin-forming agent or a reactive dye. These reactions and the resulting change brought about by them in the TE position of the fabric has been verified by applying a cationic dye to the near mid-TE position, such as −0.5 DACRON (No. 107), to become very a electropositive medium at a position of +5. Referring to Table 2, an anionic dye, applied to the same near mid-TE position caused the fabric to change to a new TE position of −4.

EXAMPLES AND TESTING

In testing using two household dyes, such as RIT manufactured by Special Products, an affiliate of CPC International, one that was labeled navy blue and another scarlet, although not recommended for polyester or acrylic fibers, were applied successfully to pre-cleaned, woven, napped polyester fabric. Canadian Wheelabrator Fry No. S350/154, piece No. 35900 was utilized for this test and was cleaned using nonionic detergent, a 140° F. wash and a thorough rinse. This fabric in the cleaned condition had a TE position of −0.1. When dyed with the blue dye, the fabric's TE position was raised to the +0.3 location. The change in the scarlet dyed sample was found to be downward to a more negative polarity of −0.7 in the TE series. Not only are these noted polarity differences real and significant, but the magnitude of the charges generated by rubbing the three fabrics with NYLON in one instance and with DARLAN in another also differ greatly. The charge developed by rubbing against NYLON was −8.8 volts for the blue sample, −14.1 volts for the undyed fabric and −15.7 volts for the scarlet sample. Similarly for the test materials rubbed with DARLAN, the blue sample responded with −6.5 volts, the undyed with −9.2 volts and the scarlet dyed fabric with +7.9 volts. The TE data are shown graphically in Table 2.

TABLE 2

A TRIBOELECTRIC SERIES
Showing Positions of Some Fabrics
before and after Modification
(an arbitrary scale)

| | | | |
|---|---|---|---|
| | (+) very electropositive (+) | | |
| +8 | | | |
| +7 | *CS&S+C.G.Max.RedGRL | | *W.F.154+C.G.Max.RedGRL |
| | *RYTON, st. | | *CS&S+MobayC |
| +6 | —— polyamide (NYLON) {afc 800b- REF} | | *CS&S+MobayD |
| | | | *CS&S+MobayE |
| +5 | *DACRON107+cat.dye | | *CS&S+MpbayA |
| +4 | | | *FIR.ST.(b) |
| +3 | | | |
| | *CS&S | *FIR.ST.(gr), | *FIR.ST.(wh) |
| +2 | | | |
| | | *CS&S+MobayF, | *FIR.ST.(ye) |
| +1 | | | *FIR.ST.(bk) |
| | *W.F.#154+RIT(b) | | *FIR.ST.(ro) |
| 0 | | *W.F.#154 | *FIR.ST (o) |
| | *W.F.#154+RIT(s) | | |
| −1 | | | |
| −2 | | | |
| −3 | | | |
| −4 | —— acrylic [dinitrile] (DARLAN) {afc 5546-REF.} | | |
| | *DACRON#107+an.dye | | |
| −5 | *CS&S+RITE(y) | | |
| | *CS&S+dmdcsi | *W.F.#154+dmdcsi | |
| −6 | *RYTON, st.+dmdcsi | | |
| | (−) very electronegative (−) | | |

Note: All locations above +6 and below −4 are approximate.
Legend: CS&S = BEANE, bulk knit, fil.; W.F. = WHEELABRARTOR FRY, st., woven napped; FIR.ST. = FIRESTONE solution dyed filling yarns; Mobay = MOBAY CHEMICAL CO. with A,B,C,D,E & F urethane finishes; st. = staple (short) fiber; fil. = filament fiber; b = blue; bk = black; o = orange; r = red; wh = white; ye = yellow; C.G.MAX.GRL = CIBA GEIGY MAXILON RED GRL-BR; RITE = RITE REACTIVE (yellow) from RITE INDUSTRIES INC.; RIT = RIT TINT AND DYE, Special Products of CPC INTERNATIONAL INC.; cat. = cationic; an = anionic; dmdcsi = dimethyldichlorosilane.

These test results indicate conclusively that polyester and other fiber based fabrics may be altered to become either electronegative or electropositive in the TE series with a preselected dye or chemical, which is selected specifically for its effect on the fibers. Other fibers and fabrics are also amenable to the changes by dyeing or chemical alteration. Accordingly, any fiber that can be modified chemically, whether directly or by means of a bridging coupler or by means of a pre-etch, should respond to appropriate treatment and provide predetermined TE properties. Although tests were directed toward conveying NYLON-like TE properties to polyesters, it should be relatively easy to make NYLON more electronegative by chemical modification or dyeing. Only the non-reactivity of the fiber limits the opportunities for TE adjustment. Thus, fibers of TEFLON and the olefins would be expected to present more difficulties in the modification process; even so, some modifications should be possible.

Once the TE properties of the desired material have been adjusted as desired, that material may be utilized as the filter medium for dusts having particulates most attractive to its polarity and magnitude. Or stated in another manner, the position of a particulate in the TE series may be determined and the filter medium having the most attractive opposite polarity TE position can be selected from the modified fabrics.

A variety of techniques are available for determining the TE properties of particles. For example, in EPA Report No. 600/7-78-142a, September, 1978, G. W. Penney described impingement methods for charging dust with sequent charge determination. One test utilized a tungsten carbide target on which the dust (silica) impinged at high velocity. The charge was read on an electric meter connected to the tungsten target. Penney later used a fabric filter as the target as supported on a metal screen which was connected directly to an electric meter. The current collected by the screen was measured by the meter and the rate of air flow through the filter was determined by means of a calibrated orifice. While an indirect approach for the determination of TE properties of the particles is described herein, the data obtained by appropriate particulate detection/measurement systems is preferred, at least for comparative data. Once the TE properties of the filter media are known, filtration tests may be conducted with such media selected for particular TE features. If, for example, different media of essentially the same construction, but made with fibers with TE properties ranging from those that are electropositive to those that are more electronegative are evaluated under the same controlled conditions, the influence of the TE position becomes evident. As pressure drop remains low and flow rates remain high without dust leakage, the more ideal media are found and the TE characteristics of these media specify those preferred for optimum performance. Once so located, the apparent TE features of the dust are indicated approximately and the most ideal fabric filter medium may be specified, especially as the filtration tests are extended to fine-tune the analysis.

Accordingly, a method is provided for selecting a filter for filtration application, the method including the steps of determining the TE properties of a fabric, chemically changing the TE properties to conform to specific desired properties, and utilizing fabric selected with the desired properties for media to filter dust and other particulate matter having TE characteristics most attracted to the fabric for promoting agglomeration on the surface of the media and an increase in density for the particulate so filtered.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

What is claimed is:

1. A method of modifying the triboelectric properties of a fiber in a filter medium, comprising the steps of:

(a) selecting a fiber appropriate for the use conditions having a known or an unknown triboelectric value; and (b) altering as needed said triboelectric value of the fiber through one of (i) chemical reaction of said fiber with a preselected reagent, (ii) ionic bonding of a preselected reagent to said fiber and (iii) absorption of a preselected reagent into said fiber to embody said fiber with a predictable and consistent triboelectric value, based on the reagent utilized and the characteristics of the underlying fiber.

2. A method as described in claim 1, wherein said reagent is utilized to increase said triboelectric value of said fiber or raise its position in the triboelectric series.

3. A method as described in claim 1, wherein said reagent is utilized to decrease said triboelectric value of said fiber or lower its position in the triboelectric series.

4. A method as described in claim 1, wherein said alteration of said triboelectric value or location in the triboelectric series is permanent.

5. A method as described in claim 4, wherein said alteration is through coordinate bonding of said reagent.

6. A method as described in claim 4, wherein said alteration is through one of chemical addition and substitution with said fiber.

7. A method as described in claim 4, wherein said fiber is monomeric.

8. A method as described in claim 4, wherein said fiber is polymeric.

9. A method as described in claim 6, wherein said reagent is selected from the group consisting of: isocyanates, silanes and Grignards.

10. A method as described in claim 9, wherein said fiber is polymeric and said reagent is an isocyanate and wherein said alteration of said fiber is performed according to the equation:

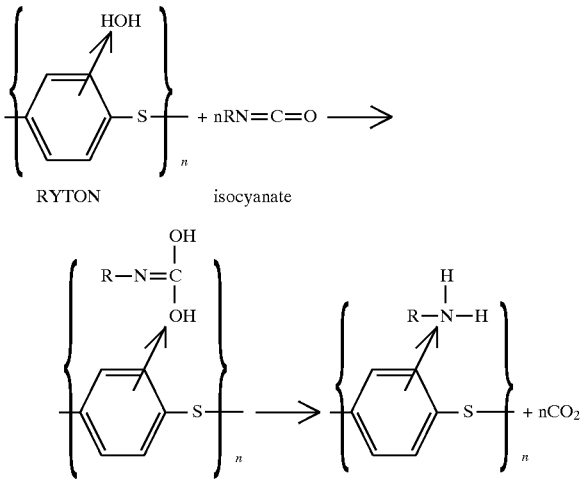

11. A method as described in claim 9, wherein said fiber is polymeric and said reagent is a silane, and wherein said complex alteration of said fiber is performed according to the equation:

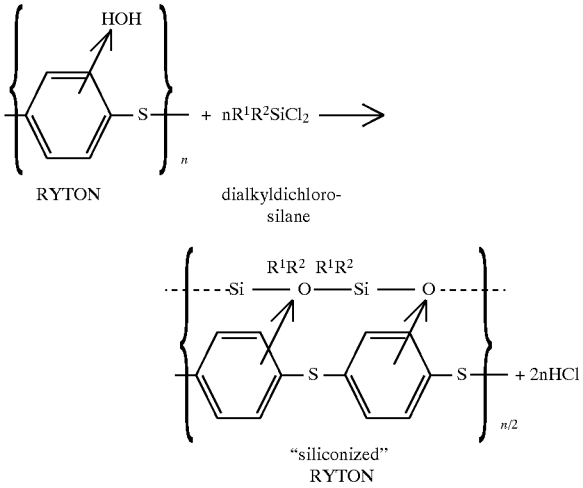

12. A method as described in claim 9, wherein said fiber is provided with an endgroup selected from the group consisting of: active hydrogens, pi-bonded water molecules, non-pi-bonded water molecules, primary amines, secondary amines, acidic groups, alkyl halides and acetylenic groups.

13. A method as described in claim 12, wherein said fiber is provided with an active hydrogen endgroup, said reagent is a Grignard reagent, and wherein said alteration step proceeds according to the following equation:

$$RH+R'MgX \rightarrow RMgX+R'H.$$

14. A method as described in claim 12, wherein said fiber is provided with a water endgroup, said reagent is a Grignard reagent, and wherein said alteration step proceeds according to the following equation:

$$HOH+R'MgX \rightarrow HOMgX+R'H.$$

15. A method as described in claim 12, wherein said fiber is provided with an amine endgroup, said reagent is a Grignard reagent, and wherein said alteration step proceeds according to the following equation:

$$—NHH+R'MgX \rightarrow —NHMgX+R'H.$$

16. A method as described in claim 12, wherein said fiber is provided with an acid endgroup, said reagent is a Grignard reagent, and wherein said alteration step proceeds according to the following equation:

$$—C—O—OH+R'MgX \rightarrow =C—O—OMgX+R'H.$$

17. A method as described in claim 12, wherein said fiber is provided with an alkyl halide endgroup, said reagent is a Grignard reagent, and wherein said alteration step proceeds according to the following equation:

$$RX+R'MgX \rightarrow RMgX_2+RR'.$$

18. A method as described in claim 12, wherein said fiber is provided with an acetylinic endgroup, said reagent is a Grignard reagent, and wherein said alteration step proceeds according to the following equation:

$$—C{=}CH+R'MgX \rightarrow —C{=}CMgX+R'H.$$

19. A method as described in claim 1, wherein said alteration step is performed by the absorption of said reagent into said fiber.

20. A method as described in claim 19, wherein said reagent changes the ionic character of said fiber.

21. A method as described in claim 19, wherein said reagent is a dye.

22. A method as described in claim 21, wherein said reagent is an azo dye.

23. A method as described in claim 22, wherein said dye is comprised of an aryl quaternary amine and sodium napthyl sulfonate.

24. A method as described in claim 21, wherein said dye further comprises chlorine.

25. A method for the identification and classification of a fiber according to its triboelectric value, comprising the steps of:

(a) selecting a fiber having unknown triboelectric properties;

(b) altering the triboelectric properties of said fiber with a preselected, particularly colored dye having particular properties, to impart a predictable, consistent triboelectric value to said fiber; and (c) correlating said consistent triboelectric value to said particular color of said dyed fiber.

26. A method of selecting a fabric for use as a filter medium, comprising the steps of:

(a) selecting a fabric comprising fibers having unknown triboelectric values;

(b) altering said triboelectric values of said fabric through one of (i) chemical reaction of said fabric with a preselected reagent, (ii) ionic bonding of a preselected reagent to said fabric and (iii) absorption of a preselected reagent into said fabric fibers to embody said fabric with predictable and consistent values of charge polarity and magnitude, based on the reagent utilized and the characteristics of the underlying fabric;

(c) correlating said fabric according to its altered triboelectric value within a series having relative triboelectric values;

(d) determining the triboelectric charge polarity and magnitude of particles to be filtered; and (e) selecting a fabric for the filter medium which is calibrated to a triboelectric charge of substantially the same magnitude but of opposite polarity of said particles.

27. A method of selecting and modifying a fabric for use as a filter medium comprising:

(a) determining the triboelectric charge polarities and magnitudes of various particles in a dust to be filtered;

(b) selecting at least one fiber type having known or unknown triboelectric properties, but having appropriate desirable characteristics for the filtration of said dust;

(c) altering the triboelectric charge polarity and magnitude properties of said at least one fiber;

(d) calibrating said at least one fiber according to the altered triboelectric properties with a series having relative triboelectric values; and (e) fabricating said fabric from said at least one fiber selected according to its triboelectric charge polarity and magnitude properties, such that said fabric is of substantially the same magnitude but of opposite polarity to at least a portion of the particles.

28. A method as described in claim 27, wherein said dust comprises particles having varying triboelectric charge magnitudes and polarities, further comprising the steps of:

(a) determining the triboelectric charge polarities and magnitudes of each type of particle in said dust;

(b) selecting a separate fiber type correlating to each type of particle, having substantially the same charge magnitude as said type of particle, and opposite polarity therefrom; and (c) constructing a fabric from said fibers.

29. A method as described in claim 28, further comprising the steps of:

(a) calculating the percentages of said types of particles in said dust; and (b) constructing said fabric from said corresponding fibers in substantially the same percentage.

30. A method as described in claim 27, wherein the alteration step further comprises altering said triboelectric value of the at least one fiber through one of (i) chemical reaction of said at least one fiber with a preselected reagent, (ii) ionic bonding of a preselected reagent to said at least one fiber and (iii) absorption of a preselected reagent into said at least one fiber to embody said at least one fiber with a predictable and consistent value, based on the reagent utilized and the characteristics of the underlying fiber.

31. A method as described in claim 30, wherein said reagent is a dye.

32. A method as described in claim 31, further comprising the steps of:

(a) correlating said altered triboelectric properties to a particular color of dyed fiber;

(b) calibrating said particularly colored dyed fiber according to a series of particularly colored dyed fibers having various, predictable triboelectric properties; and (c) incorporating at least one particularly colored dyed fiber into said fabric, such that colored dyed fibers and combinations of said colored dyed fibers may be incorporated according to percentage use of color to correspond to the percentage of particulate types to be filtered.

* * * * *